US006271758B1

(12) United States Patent
Nakamura et al.

(10) Patent No.: US 6,271,758 B1
(45) Date of Patent: Aug. 7, 2001

(54) LIGHT PROJECTION DEVICE FOR A PHOTOELECTRIC SMOKE SENSOR

(75) Inventors: Masatoshi Nakamura; Hiroshi Shima; Hidenari Matsukuma, all of Tokyo (JP)

(73) Assignee: Hochiki Corporation, Tokyo (JP)

( * ) Notice: Subject to any disclaimer, the term of this patent is extended or adjusted under 35 U.S.C. 154(b) by 0 days.

(21) Appl. No.: 09/424,511

(22) PCT Filed: May 28, 1998

(86) PCT No.: PCT/JP98/02358

§ 371 Date: Feb. 28, 2000

§ 102(e) Date: Feb. 28, 2000

(87) PCT Pub. No.: WO98/54565

PCT Pub. Date: Dec. 3, 1998

(30) Foreign Application Priority Data

May 29, 1997 (JP) ..... 9-139647
May 29, 1997 (JP) ..... 9-139666

(51) Int. Cl.[7] ..... G08B 17/10

(52) U.S. Cl. ..... 340/630; 340/627; 356/338; 356/438; 350/574; 350/564

(58) Field of Search ..... 340/630, 627, 340/628, 629; 356/338, 438, 439, 219, 229; 436/805; 250/574, 564, 573, 208.4, 575; 116/214; 324/71.4

(56) References Cited

U.S. PATENT DOCUMENTS

| | | | | |
|---|---|---|---|---|
| 4,226,533 | * | 10/1980 | Snowman | 340/630 |
| 5,008,559 | * | 4/1991 | Beyersdorf | 340/630 |
| 5,502,434 | | 3/1996 | Minowa et al. . | |
| 5,670,947 | * | 9/1997 | Nagashima | 340/630 |

FOREIGN PATENT DOCUMENTS

| | | |
|---|---|---|
| 11 15 477 B | 10/1961 | (DE) . |
| 11 77 042 B | 8/1964 | (DE) . |
| 27 58 517 A | 7/1978 | (DE) . |
| 2 302 943 A | 2/1997 | (GB) . |

* cited by examiner

*Primary Examiner*—Daniel J. Wu
*Assistant Examiner*—Anh La
(74) *Attorney, Agent, or Firm*—Sughrue, Mion, Zinn, Macpeak & Seas, PLLC

(57) ABSTRACT

A light emitting diode 1 and a condenser lens 2 are arranged in an optical axis direction. In the light emitting diode 1, a cover 4 having a tip end lens 5 is attached to one side of a main unit base 9, a light emitting chip 6 is supported by a bonding wire 8 drawn out from the body base 9 inside the cover 4, and a reflector 7 is placed behind the light emitting chip 6. With respect to a first light source of the light emitting chip 6, the position where light which is forward reflected by the reflector 7 impinges on the tip end lens 5 is set as a virtual second light source 10, and the focal point of the condenser lens 2 is set at the position of or in the vicinity of the position of the second light source 10.

7 Claims, 9 Drawing Sheets

LIGHT PROJECTION DEVICE FOR A PHOTOELECTRIC SMOKE SENSOR

TECHNICAL FIELD

The invention relates to a light projection device for a photoelectric smoke sensor in which a light beam is emitted into a monitored space and a fire is detected on the basis of attenuation of light due to smoke entering the monitored space, and particularly to a light projection device for a photoelectric smoke sensor in which the intensity distribution of a light beam is uniformalized.

BACKGROUND ART

Conventionally, in a smoke sensor of the reflection type which is used for performing fire monitoring in a wide area, a reflector plate is opposed to a smoke sensor main unit having a light projection device and a light reception device, being separated from the main unit by a predetermined monitored distance, for example, several tens of meters. A fire is detected on the basis of attenuation of light received from the light projection device which is caused by smoke entering the monitored space.

In this case, for example, a near infrared LED is used as a light emitting element for the light projection device. Light emitted from the near infrared LED is converged into beam light by a condenser lens. The beam light impinges on the reflector plate which is opposed to the light projection device being separated therefrom by the predetermined monitored distance, and is reflected thereby. The reflected light impinges on the light reception device, and a fire is detected on the basis of light attenuation due to smoke entering the monitored space.

In such a smoke sensor of the reflection type, the light projection device converts light from the near infrared LED into parallel beam light by using the condenser lens, and then emits the light into the monitored space. The beam light from the light projection device makes a round trip from the main unit and the reflector plate, and then impinges on the light reception device. In the case where the monitored distance between the light projection device and the reflector plate is as long as, for example, 40 meters, when the beam light reaches the reflector plate, the beam image is largely expanded by light diffusion. When the light reflected by the reflector plate returns to the light reception device, similarly, the beam image is largely diffused. Therefore, the light reception device can detect only a very small portion of the energy of the emitted light beam.

It has been reported that, even after a device is installed, a side wall of a building undergoes little temporal distortion. If the light intensity distribution in a section of the beam is not uniform, when a portion of a low light intensity is caused to impinge on the reflector plate by the distortion of the side wall, the light reception signal which is generated in the case where no smoke exists is very weak in level, with the result that a sufficient S/N ratio cannot be obtained. Furthermore, there arises a problem in that the maximum monitorable distance is shortened. Therefore, it is preferable that the light intensity distribution in a section perpendicular to the optical axis of beam light is made as uniform as possible.

In order to solve the problem of the nonuniform intensity distribution of beam light, for example, a light projector shown in FIG. 9 has been proposed (Japanese patent publication (Kokai) No. HEI5-79979). Referring to FIG. 9, light from a light emitting diode 105 in the light projector is introduced into a waveguide 103 by an imaging lens 104, so as to propagate in the waveguide 103, whereby the energy distribution is uniformalized. Light emitted from the end face of the waveguide 103 is imaged at a distant position by a projection lens 102.

In the structure of such a light projector which uniformalizes the energy distribution of a projection beam, the imaging lens, the waveguide, and the projection lens must be arranged in front of the light emitting diode. Therefore, the optical system for uniformalization is relatively complex, and the dimension in the optical axis direction is increased. As a result, the structure has a disadvantage that the light projector is bulky.

The invention has been conducted in view of the problems of the prior art. It is an object of the invention to provide a light projection device for a photoelectric smoke sensor in which beam light from a light emitting diode can be uniformalized in a beam section direction by a simple optical structure so as to compensate an optical axis deviation.

DISCLOSURE OF INVENTION

The invention relates to a light projection device for a photoelectric smoke sensor in which beam light is emitted into a monitored space and a fire is detected by receiving the beam light which is attenuated by smoke entering the monitored space, wherein the device comprises a light emitting diode and a condenser lens which are arranged in an optical axis direction, and the light emitting diode comprises: a main unit base; a cylindrical cover which is attached to a tip end of the main unit base and in which a lens is integrally disposed; a light emitting chip which is placed at a predetermined position inside the cover; a bonding wire through which a lead wire passing through the main unit base is electrically connected with the light emitting chip; and a reflector which is placed behind the light emitting chip.

In the thus configured light projection device, the light emitting chip may be used as a first light source, the position where light which is forward reflected by the reflector. impinges on the lens at the tip end of the cover may be set as a virtual second light source, and a focal point of the condenser lens may be located at a position of the second light source.

The light emitting chip may be used as a first light source, the position where light which is forward reflected by the reflector impinges on the lens at the tip end of the cover may be set as a virtual second light source, and a focal point of the condenser lens may be located at a position in the vicinity of the second light source.

The light emitting chip may be used as a first light source, the position where light which is forward reflected by the reflector impinges on the lens at the tip end of the cover may be set as virtual second light source, and a focal point of the condenser lens may be set located a position separated from the second light source.

The focal point of the condenser lens may be located between the second light source and a lens vertex of the tip end of the cover.

The focal point of the condenser lens may be located between the second light source and a position of a tip end of a bent portion of the bonding wire which is electrically connected with the light emitting chip.

In such a configuration, light which is generated in the front face of the chip and emitted mainly from the center portion of the tip end lens is blurred, and the blurred light is combined with light which is generated in the rear face of the chip, reflected by the reflector and emitted mainly from the peripheral portion of the tip end lens, whereby the light intensity distribution (energy intensity distribution) in a beam section perpendicular to the optical axis of the composite light can be substantially uniformalized.

Since the optical system of the light projection device is composed of only two parts, i.e., the light emitting diode and the condenser lens, the light intensity distribution in a beam section can be uniformalized by a very simple optical structure.

The invention may be used in a photoelectric smoke sensor having a reflection type smoke detecting structure in which a smoke sensor main unit having a light projection device and a light reception device; and a reflector member for reflecting light from the light projection device to the light reception device are disposed through a monitored space of a predetermined monitored distance. It is a matter of course that the invention may be used in a separation type extinction smoke sensor in which a reflector plate is not used and a light projection device and a light reception device are opposed to each other through a monitored space.

The light emitting diode may have a close-contact mask member which forms an opening of a predetermined shape for the tip end lens.

When the mask member is closely attached to the tip end of the cover of the light emitting diode, the pattern of the beam image may be set to have any shape in accordance with the shape of the opening. Even when an obstacle such as a girder which cannot be avoided exists in the monitored space, therefore, it is possible to easily remove part of beam light so that beam light does not impinge on the obstacle. According to the invention, consequently, it is possible to solve the essential problem in that the detection function is lost as a result of reception of reflection light from an obstacle.

In the mask member, a circular hole, a pinhole, a partly-cut away pinhole, a slit which elongates in a predetermined direction, or the like may be used as the opening.

BEST MODE FOR CARRYING OUT THE INVENTION

Figure 1:
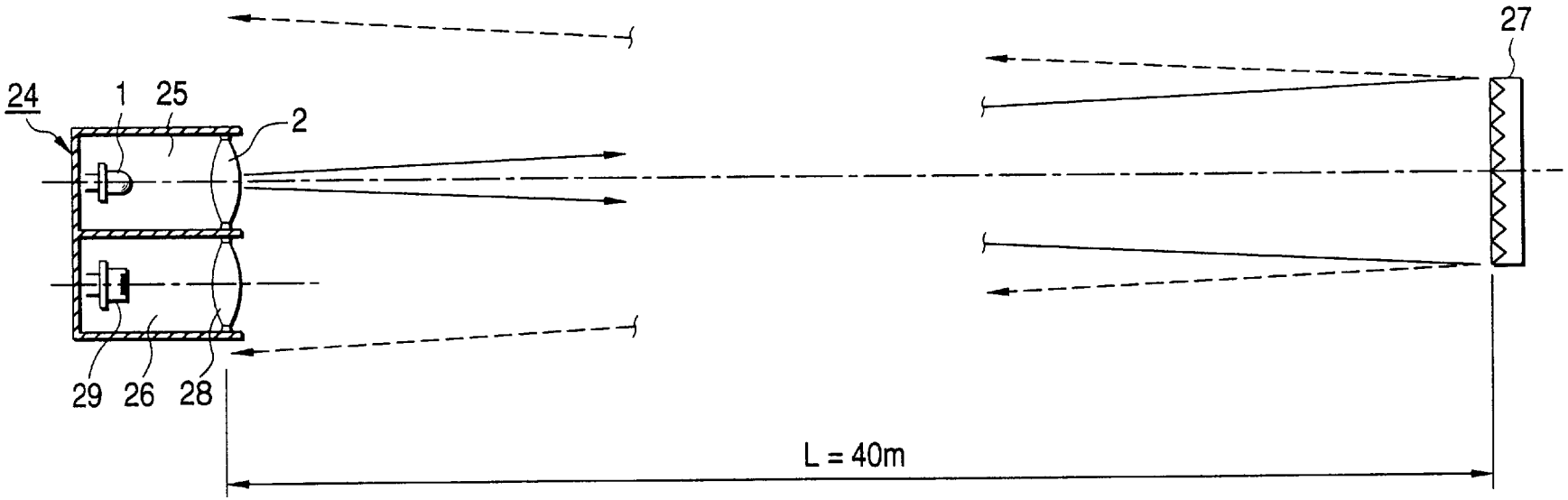
FIG. 1 is a diagram illustrating a reflection type smoke sensor using the light projection device of the invention.

FIG. 1 is a diagram illustrating a photoelectric smoke sensor using the light projection device of the invention. Referring to FIG. 1, a light projection device 25 and a light reception device 26 are disposed in the sensor main unit 24 of the photoelectric smoke sensor. A reflector plate 27 is opposed to the sensor main unit 24 and separated therefrom by a predetermined monitored distance L of, for example, 40 meters. The light projection device 25 has a light emitting diode 1 such as a near infrared LED, and a condenser lens 2. The light emitting diode 1 is intermittently driven to emit light. The light from the light emitting diode 1 is converged to be converted into parallel beam light and then emitted.

The beam light from the light projection device 25 is reflected by the reflector plate 27 so as to be returned to the light reception device 26 of the light projection device 25 as indicated by the broken lines. As the reflector plate 27, a reflex reflector which reflects incident light with high efficiency in the same direction as the direction of incidence is used. A condenser lens 28 and a light reception element 29 such as a photodiode are disposed in the light reception device 26..

Figure 2:
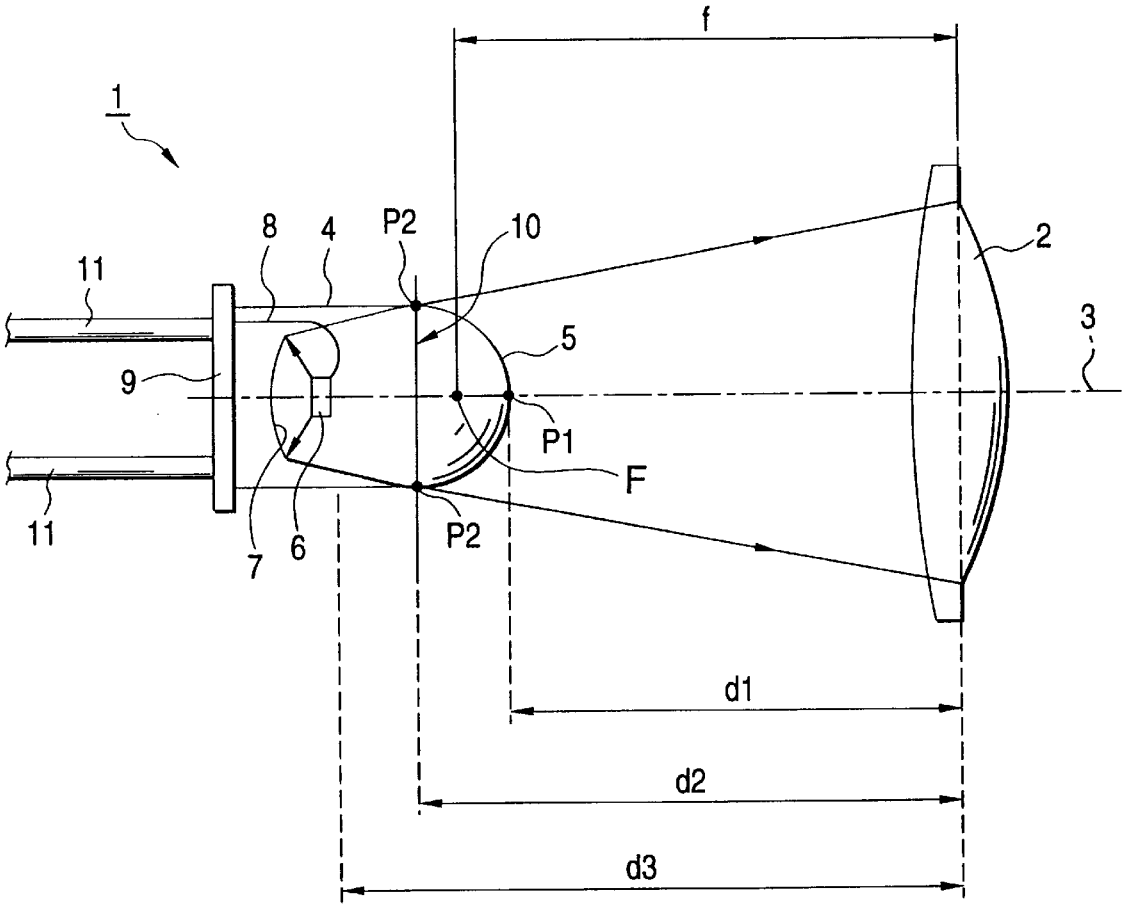
FIG. 2 is a diagram illustrating the optical structure of the light projection device of the invention.

FIG. 2 shows in detail the projection optical system of the light projection device 25 disposed in the sensor main unit 24 of FIG. 1. In the projection optical system, the light emitting diode 1 and the condenser lens 2 are arranged in the direction of the optical axis 3. The light from the light emitting diode 1 is converged by the condenser lens 2 to be converted into parallel beams and then emitted. A near infrared light emitting diode of a peak emission wavelength of, for example, 870 nm is used as the light emitting diode 1. For example, OLD2603H manufactured by Oki Electric Industry Co., Ltd. may be used as the light emitting diode.

The near infrared light emitting diode 1 has a sealed structure in which leads 11 are drawn out from a body base 9 and a cover 4 is attached to one side of the body base 9. The tip end of the cover 4 serves as a tip end lens 5. An LED chip 6 is supported inside the cover 4. A bonding wire 8 drawn out from the lead passed through the body base 9 is electrically connected with the LED chip.

When light is generated by current-driving the LED chip 6, the light is emitted from both the faces and the side faces. A reflector 7 (which if formed by processing a part of the lead) is disposed behind the LED chip 6 so that light from the side and rear faces of the LED chip 6 is reflected by the reflector to be forward emitted. In the light emitting diode 1 therefore, light mainly consisting of direct light from the front face of the LED chip 6 is emitted from the center portion through which the optical axis 3 passes, and light mainly consisting of light which is emitted form the side and rear faces of the LED chip 6 and then reflected by the reflector 7 is emitted from the periphery.

In this way, the light emitting diode 1 emits composite light of two kinds of light, i.e., light from the front face of the LED chip 6, and that which is emitted from the side and rear faces of the LED chip 6 and then reflected by the reflector 7. When the light emitting diode 1 is seen from the side of the condenser lens 2, therefore, the LED chip 6 emitting direct light serves as a first light source, and the virtual light source emitting light which is emitted from the side and rear faces of the LED chip 6 and then reflected by the reflector 7 to be incident in a doughnut-like shape on the tip end lens 5 may be deemed as a second light source 10.

The vertex of the tip end lens 5 in the cover 4 of the light emitting diode 1 is indicated by P1, and the position of the virtual second light source 10 due to light reflected by the reflector 7 is indicated by P2. The condenser lens 2 is placed with respect to the light emitting diode 1 so that the focal point F of the condenser lens 2 is located at a position of or in the vicinity of the second light source 10. In the embodiment of FIG. 2, for example, the focal point F of the condenser lens 2 having a focal length f is on the side of the interior of the LED with respect to the distance d1 between the condenser lens 2 and the vertex P1 of the tip end lens 5, and closer than the distance d2 between the condenser lens and the position P2 of the second light source 10. In other words, the condenser lens 2 is placed so that the focal point F is located between the positions P1 and P2.

The focal point F of the condenser lens 2 is set so as to be located at a position of or in the vicinity of the second light source 10. In another embodiment, therefore, the focal point F may be located between the position P2 of the second light source 10 and the LED chip 6 in accordance with the properties of the selected LED. In this case, the LED chip 6 is electrically connected with the bonding wire 8 which is drawn out in a hook-like shape from the lead passed through the body base 9, and the bent portion of the bonding wire 8 is located more forward than the LED chip 6. The distance between the condenser lens 2 and the tip end of the bent portion of the bonding wire 8 is indicated by d3. The condenser lens 2 is placed in a range where the focal length f does not exceed the distance d3, i.e., so that the focal point F is at a position which is forward shifted from the tip end of the bent portion of the bonding wire 8.

This placement of the focal point F of the condenser lens 2 with respect to the light emitting diode 1 is conducted in order that light which is emitted from the LED chip 6 and then transmitted through the tip end lens 5, and that which is reflected by the reflector 7 or generated by the virtual second light source 10 and then transmitted through the tip end lens 5 are converged by the condenser lens 2 and the intensity distribution of the resulting composite light is uniformalized.

When the focal point F of the condenser lens 2 is made coincident with the surface of the LED chip 6 of the light emitting diode 1, the beam light forms an image corresponding to the light and dark pattern of the light emitting face of the LED chip 6. Usually, a cross-shaped electrode is disposed on the light emitting face of the LED chip 6, and the electrode portion does not emit light. Therefore, the resulting image has a portion which corresponds to the electrode portion and in which the light quantity is reduced.

When the focal point F is set to be in front of the vertex P1 of the tip end lens 5, the distances from the LED chip 6 serving as the first light source and the second light source 10 due to reflection light form the reflector 7 become so large that the two kinds of light from the two light sources are excessively diffused and the converging performance is lowered. This causes the beam image to be nonuniform.

When the focal point F is set to be in front of the vertex P1 of the tip end lens 5, the distances from the LED chip 6 serving as the first light source and the second light source 10 due to reflection light from the reflector 7 become so large that the tow kinds of light from the two light sources are excessively diffused and the converging performance is lowered. This causes the beam image to be nonuniform.

Because of the reasons discussed above, according to the invention, the focal point F of the condenser lens 2 is set to be in either of the ranges shown in FIG. 2 between the tip end P1 of the cover lens and the position P2 of the second light source 10 which is due to reflection light from the reflector 7 and in the basal portion of the lens, and between the position P2 of the second light source 10 and the bent tip end of the bonding wire 8 supporting the LED chip 6. Alternatively, the focal point F may be set to be at the position of the second light source.

FIG. 3(A) shows the intensity distribution in the case where light from the light emitting diode 1 of FIG. 2 is not converged by the condenser lens 2, and FIG. 3(B) shows the intensity distribution in the case where the light is converged by the condenser lens 2 so as to be uniformalized.

In the case of FIG. 3(A), light emitted from the LED chip 6 has a light intensity distribution 14 that is obtained by combining an intensity distribution 12 of light which is emitted from the front face of the chip and then transmitted through the tip end lens 5 to be emitted therefrom, with an intensity distribution 13 of light which is generated in the side and rear faces of the chip, reflected by the reflector 7 and emitted with being transmitted through the tip end lens 5. Usually, the light intensity distribution 12 is higher in degree than the light intensity distribution 13.

In the light intensity distribution 12, the intensity is increased to a peak as moving toward the optical axis 3, and a dent is formed by the less-light quantity portion caused by the electrode in the electrode face of the LED chip 6. In order to uniformalize the composite intensity distribution of the light intensity distributions 12 and 13, therefore, the condenser lens 2 is disposed in front of the light emitting diode 1 as shown in FIG. 3(B), and the focal point F of the condenser lens 2 is located at a position where the light of the intensity distribution 12 is blurred and the degree of blur of the light of the intensity distribution 13 is minimum.

With respect to the light of the intensity distribution 12, the main components are emitted from the portion (vertex) which is a relatively center of the tip end lens 5 of the light emitting diode 1. With respect to the light of the intensity distribution 13, the main components are emitted in a doughnut-like shape from a relatively outer peripheral portion. Since the tip end lens 5 of the light emitting diode 1 has a curvature, the vertex portion and the outer peripheral portions are separated by different distances from the condenser lens 2, and hence the portions respectively serving as the light sources are different in position from each other.

In the invention, the focal point F of the condenser lens 2 is set at a position where the light of the intensity distribution 12 is blurred to be converted into that of an intensity distribution 15, light of the intensity distribution 13 is converged to be converted into that of an intensity distribution 16, and the intensity distribution of composite light obtained by combining light of the intensity distributions 15 and 16 is uniformalized as an intensity distribution 17.

In this case, when the light intensity distribution 13 is higher in degree than the light intensity distribution 12, the focal point F of the condenser lens 2 is set at a position where the light of the intensity distribution 13 is blurred and the composite distribution is uniform, i.e., the focal point F is set to be more forward than the vertex of the LED cover lens.

Figure 3:
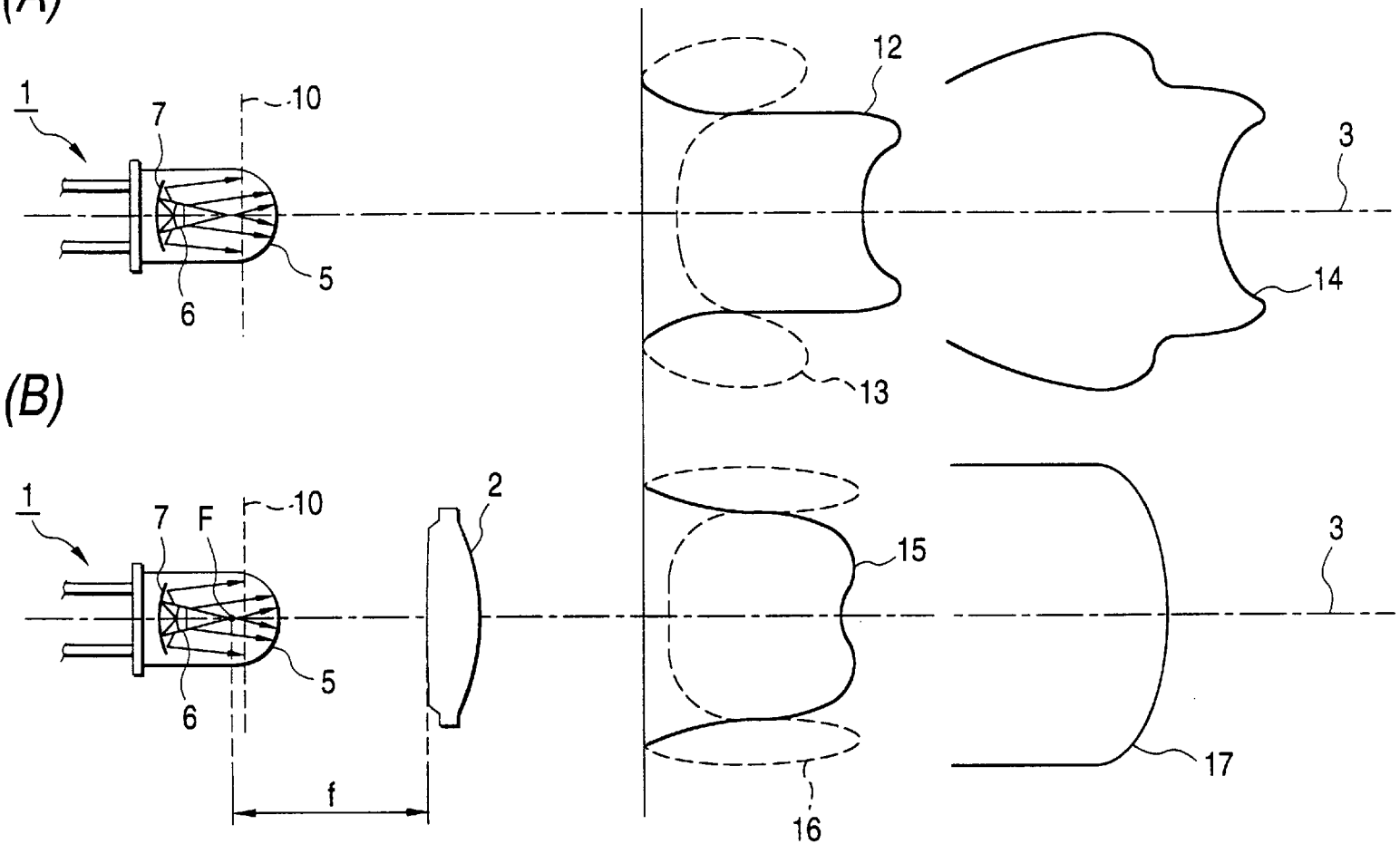
FIGS. 3(A) and (B) are diagrams illustrating the light intensity distribution of the light projection device of the invention which uniformalizes the energy distribution.

The intensity distribution of emission components of the two light sources of the light emitting diode 1 in FIG. 3 varies with LEDs. When the focal point F of the condenser lens 2 is to be actually set, the optimum position of the focal point F must be determined with checking the intensity distribution of beam light produced by the condenser lens 2, while adjusting the position of the focal point F in either of the ranges between the positions P1 and P2 of the light emitting diode 1 of FIG. 2, and between the position P2 and the tip end of the bonding wire 8.

The dimensional relationships of the projection optical system of FIG. 2 will be discussed. For example, the light emitting diode 1 has an outer diameter of about 5 millimeters. When a lens having a focal length f=32.57 millimeters is used as the condenser lens 2 and the focal point F is set to be between P1 and P2 as illustrated, for example, thee effective incidence line along which light emitted from the LED chip 6 impinges on the condenser lens 2 is in a range centered at the optical axis 3 and having a diameter of about 10 millimeters. Therefore, a lens which has an outer diameter of about 10 millimeters and a predetermined refractive index may be used as the condenser lens 2.

FIG. 4 shows variations of the projected image in the case where the position of the focal point F of the condenser lens 2 is forward moved from that of the front light emitting face of the LED chip 6.

Figure 4A:
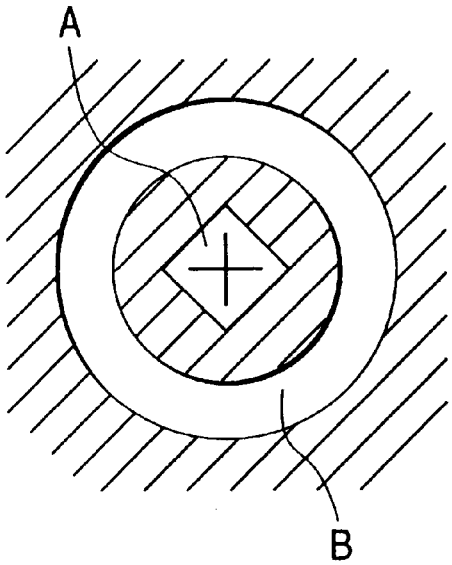
FIGS. 4(A) to (D) are diagrams illustrating projected images in the case where the position of the focal point of a condenser lens is forward moved with respect to a light emitting diode.

FIG. 4(A) shows the projected image in the case where the focal point of the condenser lens 2 is coincident with the front light emitting face of the LED chip 6. In this case, an image A of the light which is generated in the front face of the chip and then emitted with being transmitted through the tip end lens 5 is formed at the center of the projected image. Namely, the less-light quantity portion caused by the electrode appears as a cross shadow. A doughnut-shaped image B of the light which is generated in the side and rear faces of the chip, reflected by the reflector 7 and emitted with being transmitted through the tip end lens 5 appears in the periphery of the center image A.

Figure 4B:
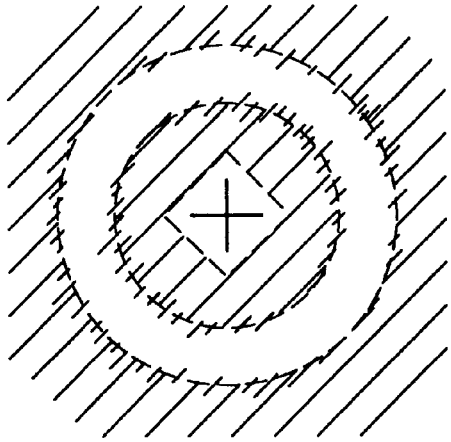
Figure 4C:
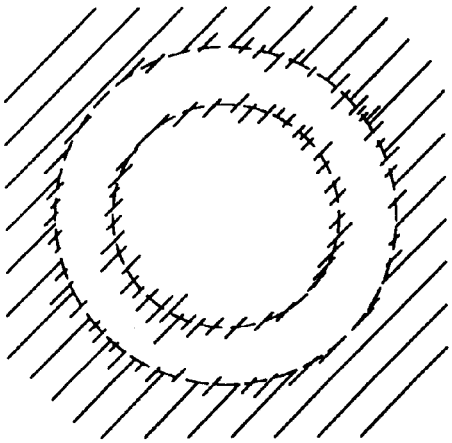
Figure 4D:
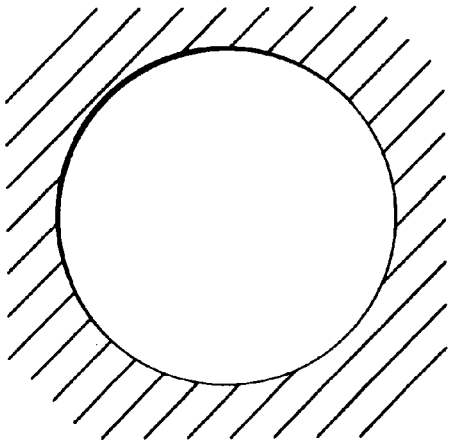

When the focal point F of the condenser lens 2 is forward moved from the state of FIG. 4(A), the center image A becomes blurred as shown in FIGS. 4(B) and 4(C). When the focal point F is further forward moved, the shadow between the images A and B disappears as shown in FIG. 4(D) and the intensity distribution is substantially uniform. When the position where light which is forward reflected by the reflector 7 behind the light emitting chip 6 impinges on the lens at the tip end of the cover is set as the virtual second light source, the focal point F of the condenser lens 2 in the case where the uniform intensity distribution of FIG. 4(D) is obtained is located at a position separated from the second light source or that in the second light source.

The light from the light emitting diode 1 is converged by the condenser lens 2 and then emitted in substantially parallel. A beam waist-like constriction is formed in a portion near the projection device. Thereafter, the light propagates in the monitored space with linearly spreading. In this case, the spread angle θ with respect to the optical axis 3 of the beam is about 4°. In the spread angle, the present device can effectively use a range of θ=about 2° in the sense of luminance.

Figure 5:
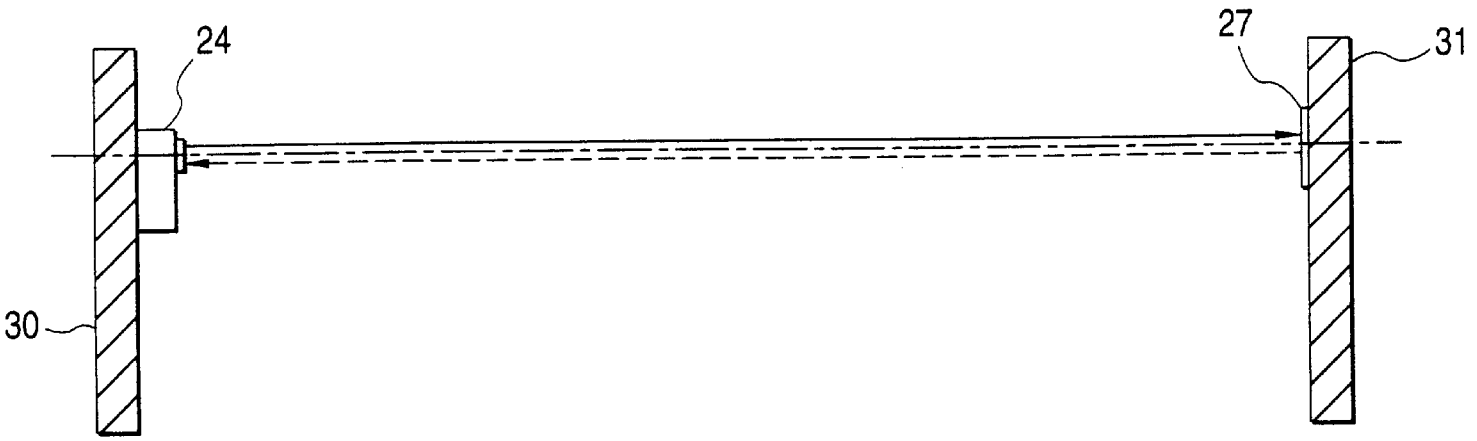
FIGS. 5(A) and (B) are diagrams illustrating an optical axis deviation in the reflection type smoke sensor of FIG. 1.
Figure 5:
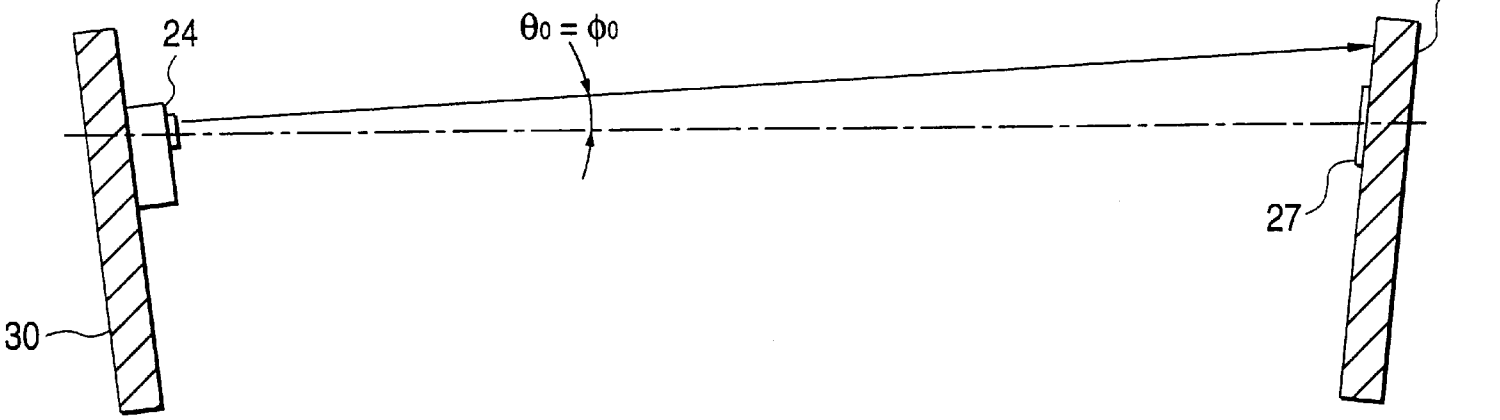

FIG. 5 illustrate an optical axis deviation due to a temporal variation of a side wall of a building on which the photoelectric smoke sensor of FIG. 1 is installed. FIG. 5(A) shows the optical axis at the installation. The optical axis alignment is conducted. while the smoke-sensor main unit 24 is installed on a side wall 30 of a building and the reflector plate 27 on an opposite side wall 31 of the building which is opposed to the smoke sensor main unit 24.

After the optical axis alignment is conducted, the side walls 30 and 31 may be inclined so that, for example, their tops are further separated from each other, by distortion of the side walls 30 and 31 which is mainly caused by expansion of the roof. In such a case, the optical axis is deviated by an angle ϕ with respect to the correct optical axis direction. According to researches conducted by the inventors et al., it has been found that the maximum angle ϕ of the optical axis deviation is about 1.7°.

When an optical axis deviation such as FIG. 5 due to distortion of the building side walls occurs, the one-side spread angle θ with respect to the optical axis of the beam from the condenser lens 2 in the projection optical system shown in FIG. 2 is set to be equal to or larger than the deviation angle θ0=1.7° of FIG. 5, and the reflector plate is placed at the center of the image. As a result, even when such an optical axis deviation occurs, the projection device can emit light toward the reflector plate 27 and then receive the reflected light. In the embodiment of FIG. 2, the spread angle θ of the parallel beam from the condenser lens 2 is about 4° (the effective spread angle is about 2°) or larger than the deviation angle θ0=1.7° of FIG. 4. Even when an optical axis deviation due to distortion of the building or the like occurs, therefore, the detection state can be stably maintained without particularly requiring the optical axis to be adjusted.

In this case, the focal point F of the condenser lens 2 in the projection optical system shown in FIG. 2 is located so as to uniformalize the beam intensity distribution with respect to the light emitting diode 1, whereby the intensity distribution in the range of the beam spread angle θ=2° is substantially uniformalized as shown in, for example, the intensity distribution 17 of FIG. 3. Even when an optical axis deviation occurs as shown in FIG. 5(B), this uniformalization allows part of the light beam to surely impinge on the reflector plate 27 so that the smoke sensor main unit 24 can receive reflected light. As a result, the level change of the quantity of reflected light which is caused by the optical axis deviation can be reduced to a low level which is negligible.

Figure 6:
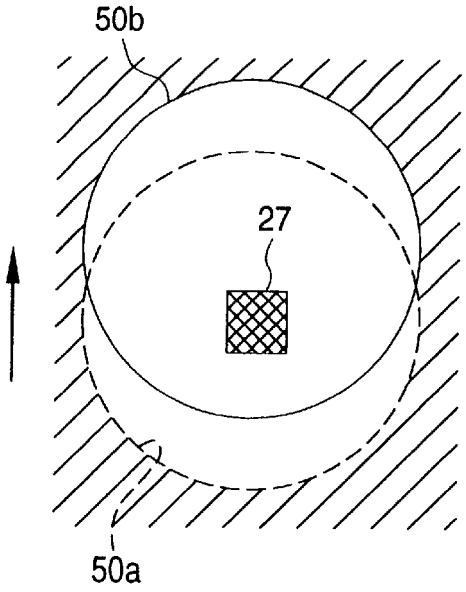
FIGS. 6(A) and (B) are diagrams illustrating a change of a projected image with respect to a reflector plate which change is caused by an optical axis deviation.
Figure 6:
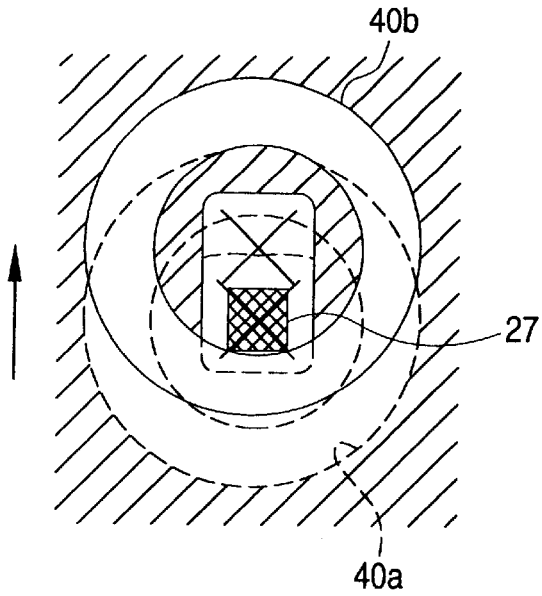

When the focal point of the condenser lens 2 is coincident with the front light emitting face of the light emitting chip, for example, a projection image 40*a* of a pattern such as FIG. 4(*a*) is received by a light reception portion 27 as shown in FIG. 6(B). When the projection image is shifted by an optical axis deviation to the position of a projection image 40*b*, the doughnut-like shadow portion between the center image and the peripheral image overlaps the reflector plate 27, and the light energy which impinges on the light reception portion is largely reduced.

By contrast, in the invention, as shown in FIG. 6(A), a projection image 50*a* in which the light intensity distribution is uniformalized as shown in FIG. 4 is received by the light reception portion 27. Even when the projection image is shifted by an optical axis deviation to the position of a projection image 50*b*, the light energy which impinges on the light reception portion is little changed.

Figure 7:
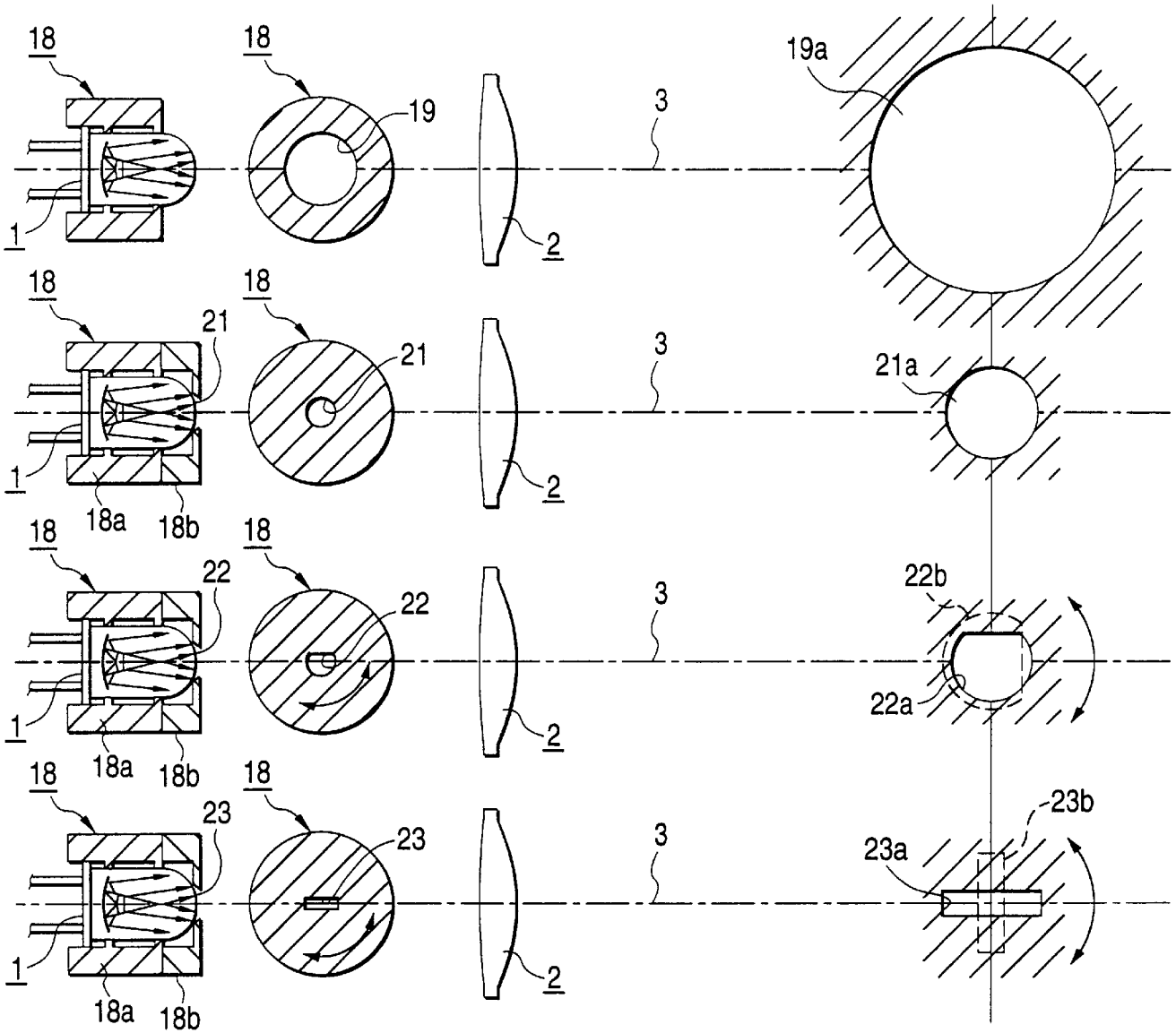
FIGS. 7(A) to (D) are diagrams illustrating an embodiment of the invention in which a mask member is disposed.

FIG. 7 shows the light projection device of the invention characterized in that a mask member which is used for arbitrarily setting the shape of a beam image is further disposed in the light emitting diode 1 of the optical system in which the focal point F of the condenser lens 2 is located with respect to the condenser lens 2 shown in FIG. 2.

FIG. 7(A) shows a first embodiment of a mask member 18. The mask member 18 in which a circular hole 19 shown in an end view on the right side is formed is closely attached to the light emitting diode 1 so that only the tip end lens 5 at the tip end of the cover 4 of the light emitting diode 1 is exposed to the outside. The formation of the circular hole 19 of the mask member 18 allows the peripheral light from the light emitting diode 1 to be cut away by, and only light which has passed through the circular hole 19 serving as an opening, to impinge on the condenser lens 2. As a result, a beam image 19*a* which is circular as seen from an optical axis section can be formed as shown in the front area along the optical axis 3.

FIG. 7(B) shows an embodiment in which a pinhole 21 is formed in the mask member 18 so as to be closely attached to the tip end of the light emitting diode 1. In the embodiment, the mask member 18 has a two-split structure consisting of a member body 18*a* and an opening member 18*b*, and, as illustrated, is fitted onto the tip end of the light emitting diode 1 while the member body and the opening member are bonded together.

The pinhole 21 is opened at a position which is at the tip end of the mask member 18 and through which the optical axis 3 passes. As a result, only light of the portion centered at the optical axis 3 passes through the pinhole 21 to impinge on the condenser lens 2, and a beam image 21*a* which is smaller in diameter than that of FIG. 7(A) can be formed as shown in an image in a section direction and in the front area along the optical axis 3.

FIG. 7(C) shows an embodiment in which a pinhole 22 having a cutaway portion is formed. When the upper portion of the pinhole is closed at an arbitrary position, for example, a cutaway pinhole image along the optical axis direction. The cutaway position of the cutaway pinhole image 22*a* can be suitably adjusted by rotating the mask member 18*b* attached to the light emitting diode 1 in the direction of the arrow, as shown in, for example, a cutaway pinhole image 22*b* which is indicated by the broken line on the right side.

FIG. 7(D) shows an embodiment in which a rectangular slit 23 is opened in the mask member 18. A rectangular slit image 23*a* is formed at the imaging position of the beam image produced by the condenser lens 2. With respect to the slit image 23*a* also, the longitudinal direction can be suitably changed by rotating the mask member 18*b* of the light emitting diode 1 in the direction of the arrow, as shown in a rectangular slit 23*b*. It is matter of course that, as required, the opening may be formed into an arbitrary shape other than those of FIGS. 7(A) to 7(D).

Figure 8A:
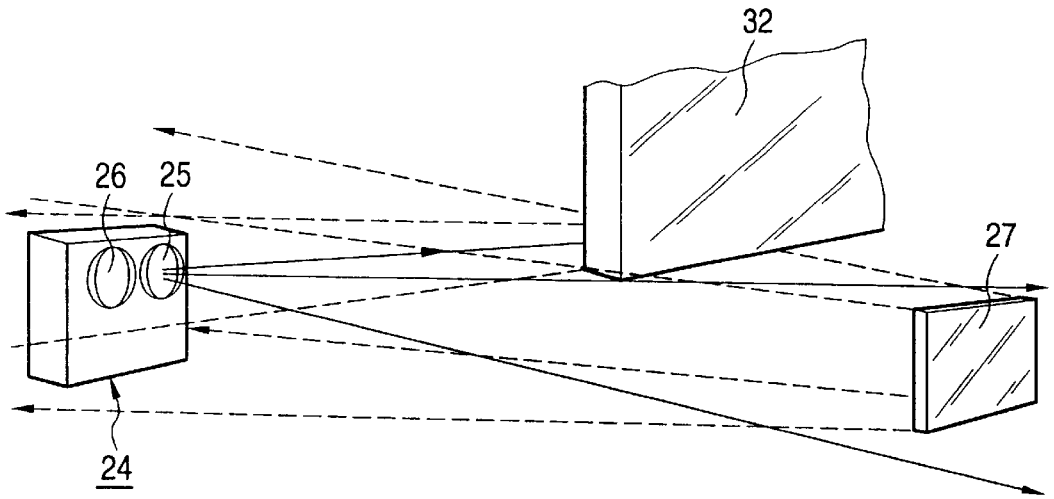
FIGS. 8(A) and (B) are diagrams illustrating reflected light produced by an obstacle in the reflection type smoke sensor of FIG. 1.

As shown in FIGS. 7(A) to 7(D), the shape of the beam image from the projection device can be suitably adjusted by the mask member 18. According to this configuration, when an obstacle such as a girder 32 exists between the smoke sensor main unit 24 and the reflector plate 27 as shown in FIG. 8(A) and part of the beam light from the light projection device 25 is reflected by the girder 32 and then impinges on the light reception device 26, for example, the shape of the beam light from the light projection device 25 can be set by the formation of the opening of the mask member 18 in order to prevent the beam light from impinging on the girder 32.

In order to compensate the above-mentioned optical axis deviation, an opening is formed in the mask member so that $\theta > 1.7°$ is attained. In this case, the opening may have any shape.

Figure 8B:
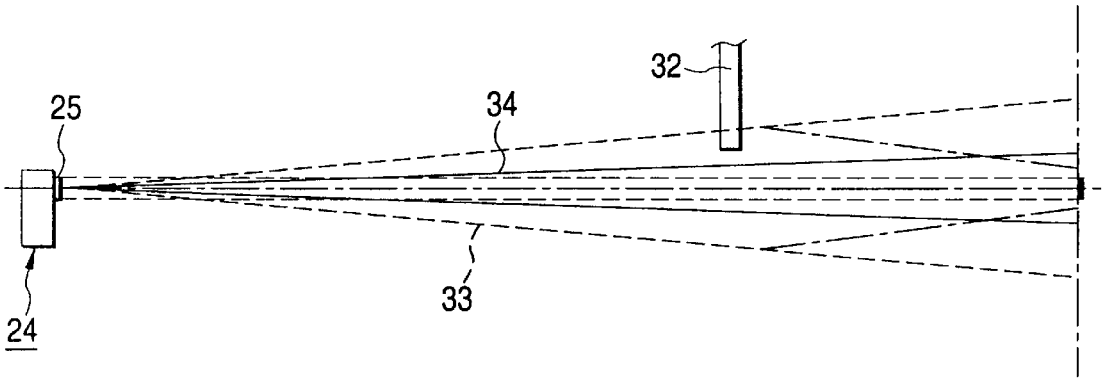
Figure 9:
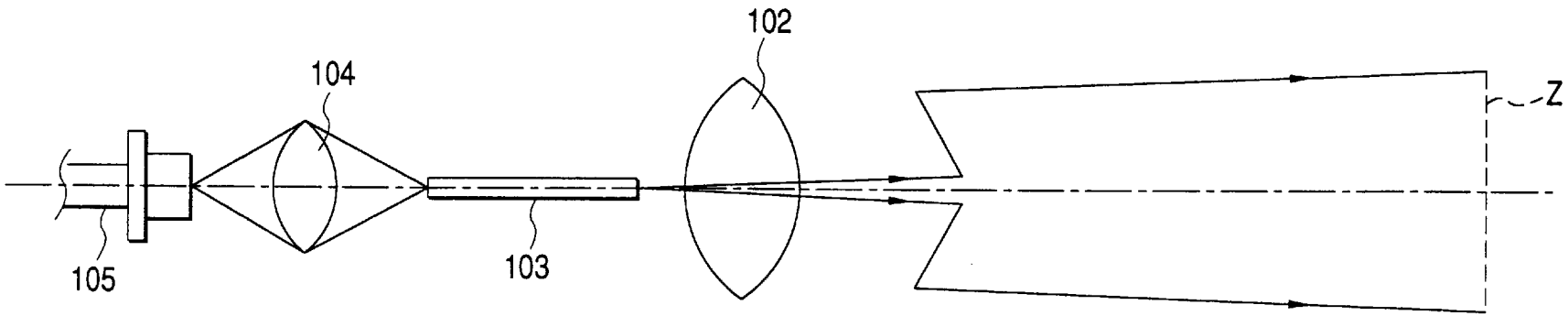
FIG. 9 is a diagram illustrating the structure of a light projection device of the prior art in which the energy distribution is uniformalized.

In the case where a mask member is not provided, for example, the beam light from the light projection device 25 impinges on the girder 32 to be reflected thereby as indicated by the broken lines in FIG. 8(B). When the mask member 18*b* having the pinhole 21 such as shown in FIG. 7(B) is set, for example, the optical axis from the light projection device 25 can be confined as indicated by the solid lines so as to avoid reflection by the girder 32. in the case where a pinhole or a very small slit is formed as shown in FIGS. 7(B), 7(C), or 7(D), it is expected that the beam is diffused by the diffraction phenomenon. However, it was confirmed that, for example, the pinhole 21 having a size of about 0.5 millimeters or less can allow the beam image to be confined without producing the diffraction phenomenon.

In the case where a pinhole or a very small slit is formed as shown in FIGS. 7(B), 7(C), or 7(D), moreover, the distribution of the emission light from the LED is delicately changed. Strictly speaking, therefore, the illumination image is slightly blurred. However, this does not produce a practical problem. If required, the position of the condenser lens can be again adjusted.

The embodiments described above are configured in a similar manner as the reflection type photoelectric smoke sensor of FIG. 1. The configuration may be applied as it is to a separation type extinction smoke sensor formed as another embodiment in which the light projection device 25 and the light reception device 26 are opposed to each other through the monitored space. In the embodiments described above, a fire is detected on the basis of attenuation of light due to smoke entering the monitored space. Similarly, the invention may be applied also to a light projection device for an intruder detecting device in which beam light is set in a monitored space and an intruder is detected on the basis of interruption of the beam light.

As described above, according to the invention, the focal point of the condenser lens is located at a position which is separated from or at a position of a virtual second light source that depends on light reflected by a reflector of a light emitting diode and that is in a basal portion of a tip end lens at the tip end of a cover. Therefore, light which is generated in the front face of the chip and emitted mainly from the center portion of the tip end lens is blurred, and the blurred light is combined with light which is generated in the side and rear faces of the chip, reflected by the reflector and emitted mainly from the peripheral portion of the tip end lens, whereby the intensity distribution (near infrared energy) in a beam section perpendicular to the optical axis can be uniformalized.

As a result of this uniformalization of the intensity distribution of a light beam, even when an optical axis deviation due to distortion of installation walls of a building or the like occurs, any part of the uniform imaging range can be caused to surely impinge on, for example, an opposed reflector plate by setting the beam spread angle to exceed the optical axis deviation angle. Therefore, the detection state can be stably maintained without being affected by an optical axis deviation due to distortion of the building.

The optical system of the light projection device is composed of only two parts, i.e., the light emitting diode and the condenser lens, and the light emitting diode can be formed by using a commercially available light emitting diode as it is. Therefore, the uniformalization of the light intensity can be realized by a simple optical structure which is low in production cost.

What is claimed is:

1. A light projection device for a photoelectric smoke sensor in which beam light is emitted into a monitored space and a fire is detected by receiving a beam light which is attenuated by smoke entering the monitored space, wherein said light projection device comprises a light emitting diode and a condenser lens which are arranged in an optical axis direction, and wherein, said light emitting diode comprises:

a main unit base;

a cylindrical cover which is attached to one side of said main unit base and to the tip end of which a lens is integrally disposed;

a light emitting chip which is placed at a predetermined position inside said cover;

a bonding wire through which a lead wire passing through said main unit base is electrically connected with said light emitting chip; and a reflector which is placed behind said light emitting chip, and said light emitting chip is a first light source; and a position where light, which is forward reflected by said reflector, is projected through said lens of said cover is a virtual second light source, wherein a focal point of said condenser lens is located between said first light source and said second light source.

2. A light projection device according to claim 1, wherein the focal point of said condenser lens is located at a position of said second light source.

3. A light projection device according to claim 1, wherein a focal point of said condenser lens is located at a position in the vicinity of said second light source.

4. A light projection device according to claim 1, wherein the focal point of said condenser lens is located between said second light source and a lens vertex of the tip end of said cover.

5. A light projection device according to claim 1 wherein the focal point of said condenser lens is located between said second light source and a position of a tip end of a bent portion of said bonding wire which is electrically connected with said light emitting chip.

6. A light projection device for a photoelectric smoke sensor according to any one of claims 1 to 3, 4, or 5, wherein said photoelectric smoke sensor has a reflection type smoke detecting structure in which a smoke sensor main unit has a light projection device and a light reception device, and a reflector member for reflecting light from said light projection device back to said light reception device is disposed by a predetermined monitored distance from said smoke sensor main unit.

7. A light projection device according to any one of claims 1 to 3, 4, or 5, wherein said light emitting diode has a mask member which forms an opening of a predetermined shape for said tip end lens, and said mask member is closely contacted with said tip end lens.

* * * * *